US006416626B1

(12) United States Patent
Park et al.

(10) Patent No.: US 6,416,626 B1
(45) Date of Patent: Jul. 9, 2002

(54) POLYETHYLENE GLYCOL-CONTAINING PAPER

(75) Inventors: David W. Park, Puyallup; Michael J. Dougherty, Roy, both of WA (US)

(73) Assignee: Weyerhaeuser Company, Federal Way, WA (US)

( * ) Notice: Subject to any disclaimer, the term of this patent is extended or adjusted under 35 U.S.C. 154(b) by 0 days.

(21) Appl. No.: 09/672,674

(22) Filed: Sep. 28, 2000

(51) Int. Cl.[7] ..... D21H 17/36

(52) U.S. Cl. ..... 162/168.1; 162/175; 162/181.6; 162/184; 347/106

(58) Field of Search ..... 162/112, 124, 162/127, 134, 135, 136, 137, 157.2, 157.3, 157.4, 157.5, 158, 164.1, 173, 183, 184, 187; 347/105, 106; 427/144, 146, 211

(56) References Cited

U.S. PATENT DOCUMENTS

| | | | | | |
|---|---|---|---|---|---|
| 4,764,418 | A | * | 8/1988 | Kuenn et al. | 428/323 |
| 4,895,757 | A | * | 1/1990 | Wysk et al. | 428/323 |
| 5,514,435 | A | * | 5/1996 | Suzuki et al. | 428/40 |
| 5,637,196 | A | | 6/1997 | Ogawa et al. | 162/135 |
| 5,643,631 | A | | 7/1997 | Donigian et al. | 427/218 |
| 5,935,384 | A | * | 8/1999 | Taniguchi | 162/172 |
| 6,048,575 | A | | 4/2000 | Altavilla | 427/144 |
| 6,054,223 | A | * | 4/2000 | Tsuchiya et al. | 428/478.2 |
| 6,099,995 | A | | 8/2000 | Altavilla | 430/31 |
| 6,110,601 | A | * | 8/2000 | Shaw-Klein et al. | 428/522 |
| 6,113,725 | A | * | 9/2000 | Kronzer | 156/230 |
| 6,132,878 | A | * | 10/2000 | Kojima et al. | 428/411.1 |

FOREIGN PATENT DOCUMENTS

| | | | | |
|---|---|---|---|---|
| JP | 52126222 A | * | 10/1977 | G03C/01/87 |
| SU | 1606931 A | * | 11/1990 | G01N/31/22 |

* cited by examiner

*Primary Examiner*—Peter Chin
*Assistant Examiner*—Eric Hug

(57) ABSTRACT

A polyethylene glycol-containing paper is described. The paper includes polyethylene glycol (PEG) having an average molar mass in the range of from about 30,000 to about 50,000. In one embodiment, polyethylene glycol is incorporated into the paper during the paper's formation. In another embodiment, a polyethylene glycol-coated paper is provided. Methods for forming polyethylene glycol-containing papers are also described.

32 Claims, 4 Drawing Sheets

HORIZONTAL

INCLINED

VERTICAL

POLYETHYLENE GLYCOL-CONTAINING PAPER

FIELD OF THE INVENTION

The present invention relates to a paper for receiving ink jet print and, more particularly, to an ink jet receiving paper that contains polyethylene glycol having an average molar mass of from about 30,000 to about 50,000.

BACKGROUND OF THE INVENTION

Ink jet recording or printing is a process by which characters and/or graphics are recorded by depositing ink droplets ejected from an ink jet head onto a recording sheet such as, for example, a paper. Ink jet recording is advantageous because high-speed recording is possible; no noise accompanies the recording; multicolor recording is easily performed; type of pattern or image to be recorded is essentially unlimited; and no development or fixing processing is required. In addition, images obtained by multicolor ink jet recording are approaching the quality of multicolor press printed images or those images obtained by color photography.

Advancements in ink jet printing have also required advancements in recording sheets for receiving the ink jet. Improvements in recording sheets have come to be required with developments in printer hardware such as increased printing speed, the development of finer definition images of full color, and expanding fields of use. Recording sheets therefore must have high image reproducibility, the image density of the printed dots must be maintained at a high level, and hue characteristics must be bright and true. Most importantly, the applied ink must be fixed quickly without bleed or spread. In addition to image sharpness and color quality, surface aesthetics including smoothness of hard copies is also required. The recording sheet surface should be flat, smooth, and free of undulation after receiving ink.

Ink recording sheets can be classified into two basic categories: (1) noncoat type and (2) coat type. Noncoat type sheets include wood-free paper, bond, and the like. Coat type sheets have an ink-receiving layer provided on a support such as paper, synthetic paper, or synthetic resin film.

For noncoat type ink jet recording sheets, the sheet itself is required to absorb the applied ink. For this purpose, a nonsized or slightly sized paper containing some sizing agent and/or an increased amount of a loading material can be employed. However, when recording is carried out with an aqueous ink, such a recording sheet suffers from the problem that, although the sheet is superior in its ink absorbency, color quality, sharpness, and density of printed . dots and images are low and deterioration of the shape of the dot and blurring of the contour of the dot occurs. Oftentimes the applied ink permeates so deeply into the layer that ink reaches the back side of the paper.

For coat type ink jet recording sheets, the recording sheet includes a support, such as a nonsized or a slightly sized paper, and one or more coating layers. Such a recording sheet is superior in its ink absorbing properties and has improved in color quality, sharpness, and reduced feathering of the resulting images, as well as reduced strike-through of ink compared with noncoated type ink jet recording sheets. For recording sheets having a coating layer on a highly sized paper support that does not absorb aqueous ink to any significant extent, dye from the ink is retained on the surface of the recording sheet (i.e., the coating layer) and image reproducibility with excellent dot density, image density, color quality, sharpness and little feathering and strike-through can be readily obtained. However, when the amount[ o]f coating is decreased, absorbency for the ink is low resulting in a decrease in ink absorbing rate and decreased ink absorption capacity. When the coating weight is increased to increase the absorption capacity, the bond between the coating layer and support tends to be weakened, thereby diminishing the integrity of the coated paper.

Accordingly, there exists a need for an ink jet recording paper having the advantages of high image density of printed dots, sharpness, and high color quality. A need also exists for a paper having these advantageous properties and that can be economically formed. The present invention seeks to fulfill these needs and provides further related advantages.

SUMMARY OF THE INVENTION

In one aspect, the present invention provides a paper for receiving ink jet printing. The paper has the favorable characteristics of color quality, sharpness, and high color density, and does not suffer appreciably from deterioration of the applied ink jet dot through feathering. The paper of the invention includes polyethylene glycol (PEG) having an average molar mass in the range from about 30,000 to about 50,000. In one embodiment, the paper includes polyethylene glycol having an average molar mass of about 35, 000.

In one embodiment, the invention provides a paper containing polyethylene glycol in which the polyethylene glycol is incorporated into the paper during the paper's formation. In another embodiment of the invention, a polyethylene glycol-coated paper is provided.

In another aspect of the invention, methods for forming polyethylene glycol-containing papers are provided.

BRIEF DESCRIPTION OF THE DRAWINGS

The foregoing aspects and many of the attendant advantages of this invention will become more readily appreciated by reference to the following detailed description, when taken in conjunction with the accompanying drawings, wherein.

DETAILED DESCRIPTION OF THE PREFERRED EMBODIMENT

Figure 1:
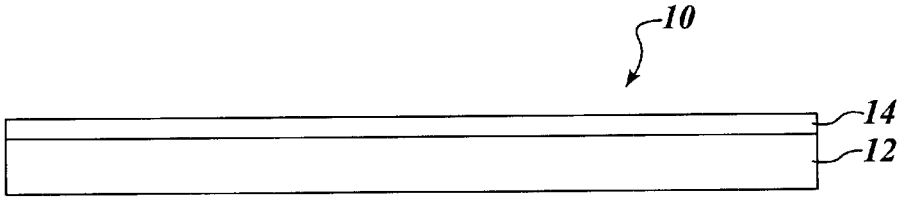
FIG. 1 is a cross-sectional view of a conventional coated ink jet paper.

In one aspect, the present invention provides a paper for receiving ink jet printing. The advantageous properties of the paper of the present invention can be attributed, at least in part, to the presence of polyethylene glycol (PEG) in the paper.

Suitable polyethylene glycols useful in the paper of the present invention have an average molecular mass in the range from about 30,000 to about 50,000. In one embodiment, the polyethylene glycol has an average molecular mass of about 35,000.

Polyethylene glycols have the following general formula:

$$H(OCH_2CH_2)_nOH \quad (1)$$

where the number n, the total number of ethylene oxide groups in the molecule, is the degree of polymerization. Polyethylene glycols with a degree of polymerization of 9 have an average molar mass of about 400, and polyethylene glycols with a degree of polymerization of 135 have an average molar mass of about 6000. For use in the present invention, suitable polyethylene glycols have a degree of polymerization from about 680 to about 1150.

Because polyethylene glycols are polymers, they exist not as uniform chemical compounds, but rather as mixtures of very similar polymer homologues. The determining characteristic of any polyethylene glycol is its average molar mass, which can be established from the hydroxyl number, which in turn can be determined analytically. The hydroxyl number and the molar mass are inversely related: low molar mass polyethylene glycols have higher. hydroxyl numbers and higher molar mass polyethylene glycols have lower values. Suitable polyethylene glycols are commercially available from a number of sources including Clariant Corporation (Charlotte, N.C.).

In one embodiment, the present invention provides a paper containing polyethylene glycol containing an average molar mass in a range from about 30,000 to about 50,000. Suitable polyethylene glycols having an average molar mass above about 50,000 are not commercially available. Polyethylene glycols having an average molar mass less than about 30,000 are significantly less effective as illustrated by the examples below. Higher molecular weight polyethylene oxides have viscosities in excess of materials suitably applied with a conventional size press.

The paper of the invention can be formed through the use of a conventional two-roll, flooded nip size press. In such a paper making process, the polyethylene glycol is added at the size press along with other surface additives including, for example, starches, polyvinyl alcohols, silicas, and cationic polymers. To produce the paper of the present invention in large volumes, paper making machines that include a metered size press or a gate roll size press can be used.

The compositions and methods of the invention are adaptable for application to a metered site press, such as those installed on large, low unit cost paper machines. By this method, the polyethylene glycol component is applied as part of the papermaking process, rather than as a separate, additional step after the normal papermaking operations are completed. In paper coating methods, the additional coating step substantially increases the cost of the process and finished product. Because the metered size press typically applies materials to both sides of a paper, the process provides a paper in which both sides have been treated. Thus, when formed as described above, both sides of the paper of the invention are available for printing. This is in contrast to conventional, expensive, high-quality commercial papers having only a single coated side. Therefore, the paper of the invention offers process advantages as well as a cost advantage.

For a conventional two-roll size press, the maximum tolerable viscosity for a formulation to be applied is about 300 Centipoise, with a viscosity of about 100 or less being preferred. Although high viscosity materials (up to about 1000 Centipoise) can be applied using a metered size press, such practices are disadvantageous for many reasons. Therefore, there is a practical viscosity limit of about 100 Centipoise (cps) for size press formulations on a conventional size press. Higher viscosities can result in film split on the paper surface and the depositing of the chemicals on the felts and dryers.

For reasons of viscosity, the polyethylene glycols having an average molar mass in the range from about 30,000 to about 50,000 are well suited for use in conventional two-roll presses as well as in metered size presses.

Figure 2:
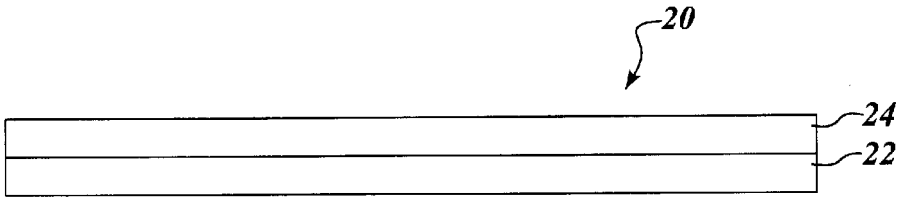
FIG. 2 is a cross-sectional view of a representative paper formed by a two-roll size press in accordance with the present invention.
Figure 3:
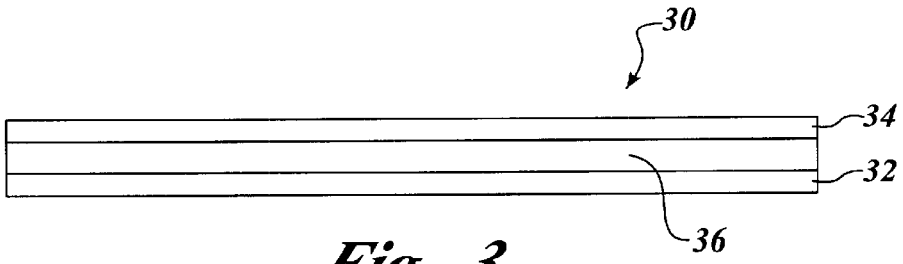
FIG. 3 is a cross-sectional view of a representative paper formed by a metered size press in accordance with the present invention.

Representative papers formed in accordance with the present invention are illustrated schematically in FIGS. 2 and 3. For comparison, a conventional coated paper is illustrated schematically in FIG. 1. Referring to FIG. 1, coated paper 10 includes base paper 12 and coating 14. Coating 14 is a surface coating that lies adjacent the surface of base paper 12. Generally, a binder is required to affix the coating to the base paper.

Figure 4A:
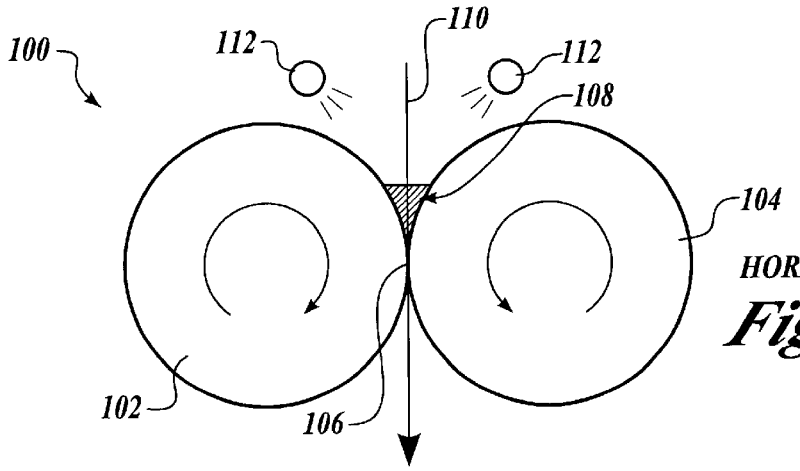
FIGS. 4A–C are schematic representations of a horizontal1size press, inclined size press, and vertical size press, respectively.
Figure 4B:
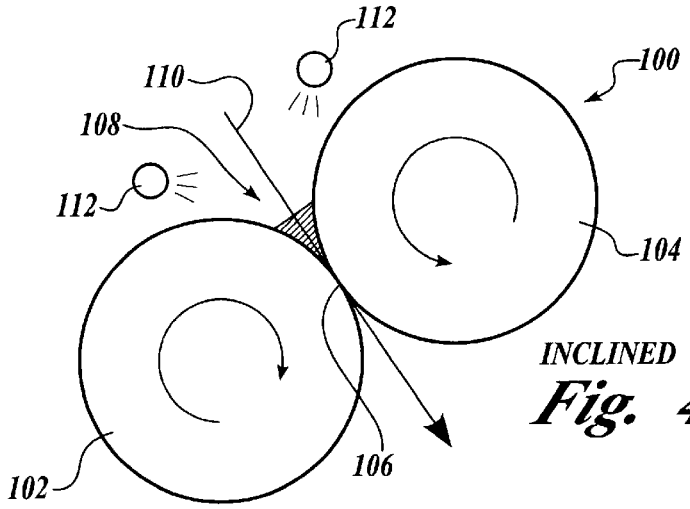
Figure 4C:
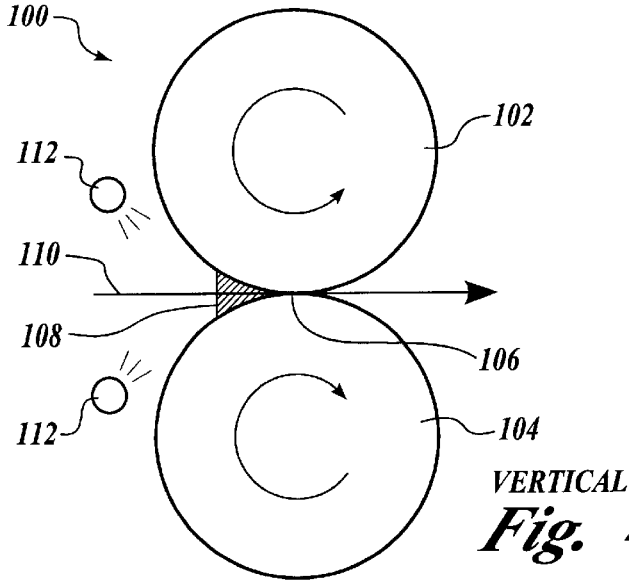

FIG. 2 illustrates a representative paper of the invention obtainable from a papermaking method using a two-roll size press. Referring to FIG. 2, paper 20 includes regions 22 and 24, each of which is composed of a mixture of base paper components and components from the applied polyethylene glycol-containing formulation. Paper 20 represents a polyethylene glycol-containing paper "saturated" with the applied polyethylene glycol-containing formulation. The paper is referred to as "saturated" because the polyethylene glycol-containing formulation applied to each major surface of the paper during the papermaking process and has not left a region of the paper without polyethylene-glycol. For a relatively thick paper, or a paper having a relatively high basis weight, saturation would not readily occur. Representative size presses are illustrated schematically in FIGS. 4 A–C. FIGS. 4 A–C illustrate horizontal, inclined, and vertical size presses, respectively. Referring to these figures, each size press 100 includes rolls 102 and 104 defining nip 106 that contains a puddle 108 of material to be applied to web 110.Material to be applied to the web is provided by supplies 112.

FIG. 3 illustrates a representative paper of the invention obtainable from a papermaking method using a metered size press. Referring to FIG. 3, paper 30 includes regions 32 and 34, each of which is composed of a mixture of base paper components and components from the applied polyethylene glycol-containing formulation. Region 36 is composed of the ingredients of the furnish making up the paper base and is substantially lacking any of the components from the applied polyethylene glycol-containing formulation. In one embodiment, region 32 has a thickness that is about 25 percent the thickness of the paper, region 34 has a thickness that is about 25 percent the thickness of the paper, and region 36 has a thickness that is about 50 percent the thickness of the paper. Other thicknesses of regions 32, 34, and 36 can be achieved by the method of the invention.

Figure 5A:
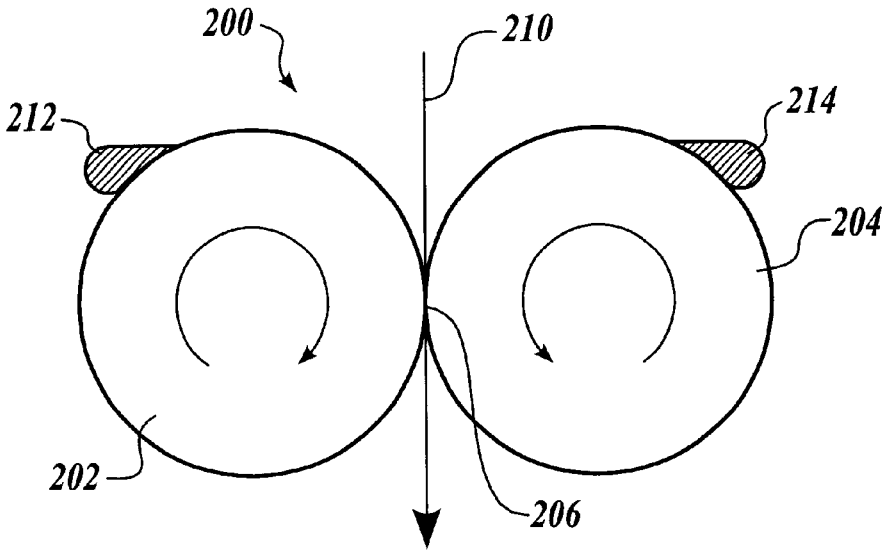
FIGS. 5A and B are schematic representations of a metered size press and a metering head, respectively.
Figure 5B:
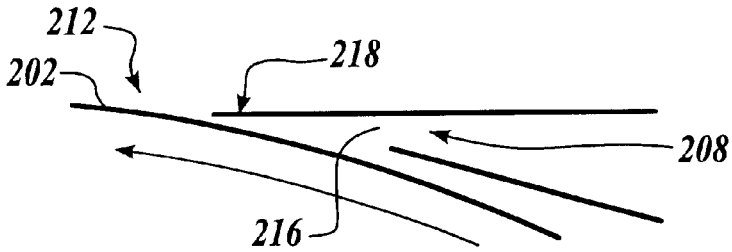
Figure 6:
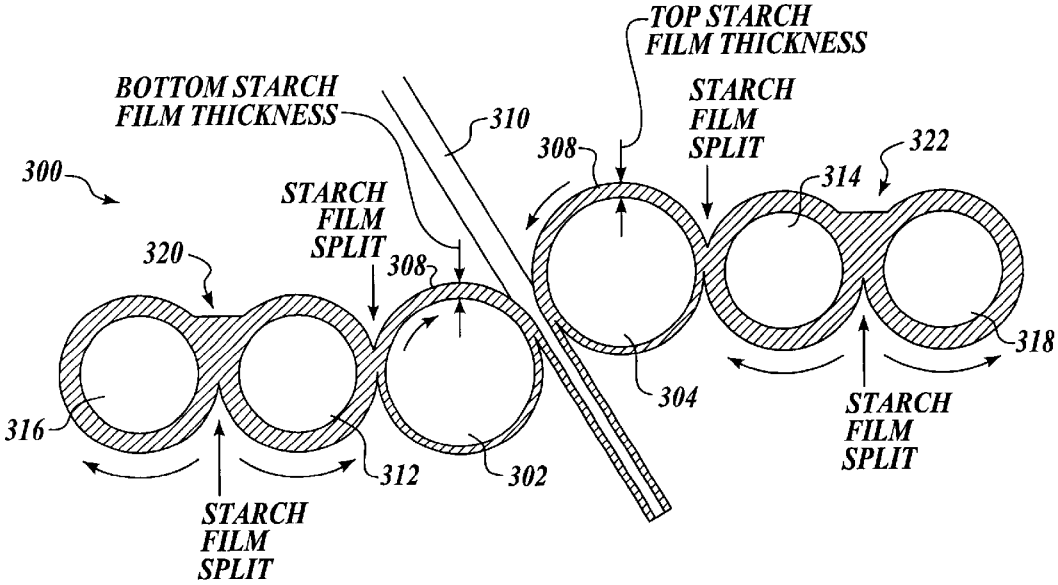
FIG. 6 is a schematic representation of a gate roll size press.

In addition to conventional size presses, representative papers of the invention can be prepared using metered size presses and gate roll size presses. A representative metered size press is illustrated schematically in FIG. 5A. Referring to FIG. 5A, each press 200 includes transfer rolls 202 and 204 defining nip 206 through which travels web 210. Material 208 to be applied to the paper is provided by metering heads 212 and 214. FIG. 5B schematically illustrates a representative metering head. Referring to FIG. 5B, metering head 212 includes port 216 through which material 208 is applied to transfer roll 202. Head 212 also includes blade 218. A representative gate roll size press is illustrated schematically in FIG. 6. Referring to FIG. 6, press 300 includes applicator rolls 302 and 304 through which travels web 310. Material 308 to be applied to the web is provided by inner gate rolls 312 and 314 in communication with outer gate rolls 316 and 318, respectively. Inner and outer gate rolls define a nip and creates materials (e.g., starch) ponds 320 and 322. Inner and outer gate rolls provide a film (e.g., starch) to the applicator rolls which in turn apply material to the web.

The paper of the invention includes a polyethylene glycol having an average molar mass in the range from about 30,000 to about 50,000. In one embodiment, the paper includes a polyethylene glycol having an average molar mass of about 35, 000.

The paper of the invention includes an effective amount of polyethylene glycol. An effective amount of ethylene glycol is an amount effective to achieve the ink jet print qualities described herein. To achieve sufficient ink print quality, in one embodiment, the paper includes polyethylene glycol in an amount from about 0.5 to about 15 percent by weight based on the total weight of the paper. In another embodiment, the paper includes from about 1 to about 10 percent by weight polyethylene glycol based on the total weight of the paper. In a further embodiment, the paper includes from about 2 to about 6 percent by weight polyethylene glycol based on the total weight of the paper. In another embodiment, the paper includes from about 3 to about 5 percent by weight polyethylene glycol based on the total weight of the paper. For papers including less than about 0.5 percent by weight polyethylene glycol based on the total weight of the paper, no ink print quality enhancement is observed. For papers including greater than about 10 percent by weight polyethylene glycol based on the total weight of the paper, the integrity of the paper surface begins to deteriorate and additives (e.g., binders) are preferably included to counteract the effect of high polyethylene glycol content.

The polyethylene glycol-containing paper of the invention can further include one or more additives common to papers. These additives can include, for example, binders, pigments, and surface sizes. Representative binders include starch and modified starches, polyvinyl alcohol, and latexes. Suitable starches are commercially available from Penford Products, Cargill Inc., and National Starch, among others. Representative pigments include calcium carbonate, clay, titanium dioxide, silica gel, fumed silica, precipitated silica, and colloidal silica. Representative surface sizes include maleic anhydride, styrene, styrene-acrylic acids, and styrene acrylic esters. In one embodiment, the paper of the invention includes polyethylene glycol, a binder, and a pigment. In one embodiment, the paper includes polyethylene glycol, starch, and silica gel.

Paper containing polyethylene glycol formed as described above has an ink jet print quality comparable to surface coated paper formed by a two-step process (i.e., make paper and then apply coating). Such surface coated papers are formed by applying a surface film to a conventional fine paper that includes a binder for adhering the surface film to the paper base. The surface film is specifically formulated for receiving ink from an ink jet. Commercially available surface coated ink jet papers are expensive because of the two-step processing required to form such papers. Surface coated ink jet papers are commercially available and include CANON HR 101, Weyerhaeuser Satin, and Arkwright Satin Bond.

The ink jet print quality of the paper of the present invention is comparable to that of commercially available surface coated papers. Ink jet print quality can be determined by measuring the optical density of paper to which ink has been applied. As used herein, the term "optical density" refers to the ability of a material to absorb light. The less light reflected from a material, the greater the material's optical density. Optical density can be measured by a densitometer, a device that measures and displays the amount of light that is reflected from a surface. A densitometer includes a light source for illuminating a surface at an angle of 45 degrees and a light sensitive photocell positioned at 0 degrees relative to the surface for receiving light. Optical filters are used to select for the measurement of specific wavelengths (i.e., colors). A densitometer is used in printing applications to monitor color control. Typical measured colors include cyan, magenta, yellow, and black.

The formation of representative papers of the invention incorporating suitable polyethylene glycols and their ink jet print quality are described in Examples 1 and 2. A comparison of ink jet papers prepared from various molecular weight polyethylene glycols is described in Example 3.

In another embodiment, the present invention provides a polyethylene glycol-coated paper. The preparation and properties of a representative polyethylene glycol-coated paper is described in Example 4.

The follow examples are provided for the purpose of illustrating, not limiting, the invention.

EXAMPLES

Example 1

Pilot Size Press Trial for Forming a Representative Ink Jet Paper

In this example, the formation of representative polyethylene-glycol containing papers formed in accordance with the present invention is described. The ink jet print quality of these representative papers is also described.

A pilot scale size press (two-roll size press) trial was conducted at the Beloit Research Center (Beloit, Wis.). Mill-produced paper without size press starch and additives was prepared for the pilot trial. In the trial, six papers (B–G) having different amounts of polyethylene glycol having an average molar mass of 35,000 ("PEG 35,000") were prepared. Paper B included 2.2 percent by weight polyethylene glycol based on the total weight of paper; Paper C included 2.6 percent by weight polyethylene glycol based on the total weight of paper; Paper D included 3.0 percent by weight polyethylene glycol based on the total weight of paper; Paper E included 4.5 percent by weight polyethylene glycol based on the total weight of paper; Paper F included 2.6 percent by weight polyethylene glycol based on the total weight of paper; and Paper G included 3.0 percent by weight polyethylene glycol based on the total weight of paper A control paper was prepared in a similar manner and included size press starch and a styrene acrylate surface size. The control did not include polyethylene glycol.

The ink jet print quality for the papers prepared as described above was determined and the results summarized in Tables 1 and 2 below. In these tables, representative papers of the present invention (B–G) are compared to the control paper, and a surface coated paper commercially available from Canon under the designation Canon Brilliant White. Table 1 summarizes the ink jet print obtained using a Canon BJC-1000 printer, and Table 2 summarizes the ink jet print quality obtained using a Canon BJC-2000 printer. In the tables, ink densities (optical densities), for the colors black, cyan, magenta, and yellow are presented.

TABLE 1

Ink Jet Print Quality: Canon BJC-1000 Printer.

| Paper | Ink Density | | | |
|---|---|---|---|---|
| | Black | Cyan | Magenta | Yellow |
| Commercial | 1.33 | 1.07 | 1.09 | 0.72 |
| Control | 1.14 | 1.01 | 1.00 | 0.66 |
| B | 1.35 | 1.10 | 1.11 | 0.68 |
| C | 1.26 | 1.10 | 1.08 | 0.73 |
| D | 1.44 | 1.14 | 1.18 | 0.73 |
| E | 1.34 | 1.11 | 1.12 | 0.77 |
| F | 1.43 | 1.11 | 1.14 | 0.70 |
| G | 1.34 | 1.08 | 1.09 | 0.71 |

TABLE 2

Ink Jet Print Quality: Canon BJC-2000 Printer.

| Paper | Ink Density | | | |
|---|---|---|---|---|
| | Black | Cyan | Magenta | Yellow |
| Commercial | 1.39 | 1.17 | 1.17 | 0.74 |
| Control | 1.18 | 1.12 | 1.05 | 0.68 |
| B | 1.43 | 1.21 | 1.16 | 0.68 |
| C | 1.35 | 1.20 | 1.16 | 0.74 |
| D | 1.46 | 1.27 | 1.22 | 0.71 |
| E | 1.37 | 1.24 | 1.21 | 0.78 |
| F | 1.42 | 1.22 | 1.18 | 0.68 |
| G | 1.37 | 1.23 | 1.17 | 0.73 |

The results show that Formulas B, D, E, and F exceeded both the control and lightly coated ink jet paper for print quality.

As can be seen from these tables, the representative papers of the invention provide comparable or superior results with regard to optical density compared to the commercially available surface coated paper. The papers of the invention had print qualities significantly greater than the paper that did not include polyethylene glycol.

Example 2

Paper Machine Trial for Forming a Representative Ink Jet Paper

A paper machine trial was conducted to determine the effectiveness of polyethylene glycol having an average molar mass of about 35,000 ("PEG 35,000") as a print enhancer for papers receiving ink from ink jet printers. The paper was prepared from a furnish including a blend of hardwood and softwood fibers. The furnish also included precipitated calcium carbonate (about 18 percent by weight based on the total weight of the paper) as filler. Wet end starch, sizing, optical brighteners and retention aids, all standard papermaking additives, were also included. The basis weight target for the paper was 61 lbs. /3300 sq. ft. A conventional two-roll size press was used.

The composition of the wet end additive formulation is summarized in Table 3.

TABLE 3

Representative Polyethylene Glycol-Containing Formulation.

| Component | % Total Solids | Dry Wt. (lbs) | Wet Wt. (lbs) | Total Wt. (lbs) |
|---|---|---|---|---|
| Size press starch | 30 | 14.00 | 46.7 | 46.7 |
| Silica gel[1] | 10 | 2.55 | 25.5 | 25.5 |
| PEG 35,000[2] | 40 | 5.74 | 14.6 | 14.6 |
| Surface size[3] | 25 | 0.128 | 0.51 | 0.51 |
| Cationic polymer[4] | 50 | 1.0 | 2.0 | 2.0 |
| Water | — | — | — | 8.7 |

[1]W. R. Grace Co.
[2]Clariant Corp.
[3]Basoplast (styrene-acrylic ester), BASF
[4]polyDADMAC, Nalco Chemical Co.

The above formulation was applied at the size press during paper formation at two weights: (1) 140 lbs. formulation/ton paper and (2) 190 lbs. formulation/ton paper. The formulation included about 25 percent by weight polyethylene glycol (average molar mass of about 35,000) based on the total weight of the formulation, corresponding to applying (1) about 35 lbs. polyethylene glycol/ton paper and (2) about 48 lbs. polyethylene glycol/ton paper, respectively. Thus, the two papers included about 1.75 and about 2.5 percent by weight polyethylene glycol based on the total weight of the paper, respectively.

The two papers, prepared as described above, and a control paper were evaluated for print quality on three printers: Epson Stylus 740, Canon BJC 1000, and HP 694C. Print quality was determined by measuring optical density values for cyan, magenta, yellow, and black, with a Gretag densitometer. The results for the papers including about 1.75 and about 2.5 percent by weight polyethylene glycol based on the total weight of paper, Condition 1 and Condition 2, respectively, are summarized in Tables 4–6.

TABLE 4

Ink Jet Print Quality: Hewlett Packard 694C.

| Paper | Black | Cyan | Magenta | Yellow |
|---|---|---|---|---|
| Control | 1.49 | 0.74 | 0.8 | 0.84 |
| Condition 1 | 1.54 | 0.87 | 0.94 | 0.91 |
| Condition 2 | 1.56 | 0.93 | 1.0 | 0.97 |

TABLE 5

Ink Jet Print Quality: Canon BJC 1000 Printer.

| Paper | Black | Cyan | Magenta | Yellow |
|---|---|---|---|---|
| Control | 0.9 | 1.05 | 0.97 | 0.7 |
| Condition 1 | 1.03 | 1.24 | 1.04 | 0.74 |
| Condition 2 | 1.09 | 1.26 | 1.09 | 0.76 |

TABLE 6

Ink Jet Print Quality: Epson Stylus 740.

| Paper | Black | Cyan | Magenta | Yellow |
|---|---|---|---|---|
| Control | 1.41 | 1.21 | 1.07 | 0.82 |
| Condition 1 | 1.46 | 1.35 | 1.10 | 0.90 |
| Condition 2 | 1.52 | 1.40 | 1.15 | 0.94 |

As indicated by the tables above, the optical density values for these papers were substantially improved by the addition of polyethylene glycol. In addition to the enhanced optical density values, these polyethylene glycol-containing papers had improved feathering, wicking, and color bleed properties compared to the control.

Example 3

Comparison of Various Polyethylene Glycols For Enhancing Ink Jet Printability In this example, the printability of papers including polyethylene glycol and high molecular weight polyethylene oxide is compared. The base paper was used to determine the effectiveness of polyethylene glycols for enhancing ink jet print quality.

Polyethylene glycols having various average molar masses were blended with an ethylated size press starch and applied to the base paper with a laboratory puddle press. In addition to polyethylene glycols having average molar masses of 300 (PEG300), 900 (PEG900), and 35,000 (PEG35K), polyethylene oxide having an average molar mass of 100,000 (PEO100K) was also applied to the base paper and its print quality measured. Polyethylene glycol having an average molar mass of 300 (PEG300) was obtained from Dow Chemical Co.; polyethylene glycol having an average molar mass of 900 (PEG900) was obtained from Dow Chemical Co.; polyethylene glycol having an average molar mass of 35,000 (PEG35K) was obtained from Clariant Corp.; and polyethylene oxide having an average molar mass of 100,000 (PEO100,000) was obtained from Union Carbide. These materials were applied to the paper as formulations containing about 10 percent by weight polyethylene glycol based on the total weight of the formulation. The formulations were applied to the paper at level of about 100 lbs./ton paper. However, due to its high viscosity, the polyethylene oxide-containing formulation included only about 5 percent by weight polyethylene oxide (PEO100K). A control paper was prepared as described above with only starch being applied to the paper.

It was surprisingly found that the paper containing polyethylene glycol having an average molar mass of 35,000 (PEG35K) had ink jet print quality that was significantly enhanced compared to the papers containing the lower molecular weight polyethylene glycols and the control paper. The paper containing the polyethylene oxide having an average molar mass of about 100,000 (PEO100K) performed adequately, but the viscosity (300 cps) of the formulation including containing the polyethylene. oxide, even at a 5 percent by weight concentration, was in excess of that practical on a two-roll size press.

Tables 7 and 8 tabulate the optical densities for several colors obtained from the paper prepared as described above. Table 7 summarizes the optical densities obtained using a Canon BJC-1000 printer, and Table 8 summarizes the optical densities obtained using a Hewlett Packard 694C printer.

TABLE 7

| Optical Density: Canon BJC 1000 Printer. | | | | |
|---|---|---|---|---|
| Paper | Black | Cyan | Magenta | Yellow |
| Control | 0.88 | 1.14 | 1.00 | 0.74 |
| PEG300 | 0.95 | 1.18 | 1.03 | 0.72 |
| PEG900 | 0.89 | 1.23 | 1.06 | 0.73 |
| PEG35K | 1.06 | 1.43 | 1.16 | 0.78 |
| PEO100K | 1.11 | 1.39 | 1.18 | 0.79 |

TABLE 8

| Optical Density: Hewlett Packard 694C Printer. | | | | |
|---|---|---|---|---|
| Paper | Black | Cyan | Magenta | Yellow |
| Control | 1.50 | 1.21 | 1.16 | 0.99 |
| PEG300 | 1.52 | 1.19 | 1.16 | 1.01 |
| PEG900 | 1.48 | 1.23 | 1.18 | 0.98 |
| PEG35K | 1.55 | 1.41 | 1.33 | 1.10 |
| PEO100K | 1.51 | 1.30 | 1.26 | 1.08 |

Referring to the results in Tables 7 and 8, paper including polyethylene glycol having an average molar mass of about 35,000 have the greatest enhancement in optical density.

Example 4

Representative Polyethylene Glycol Coated Ink Jet Paper

Figure 7:
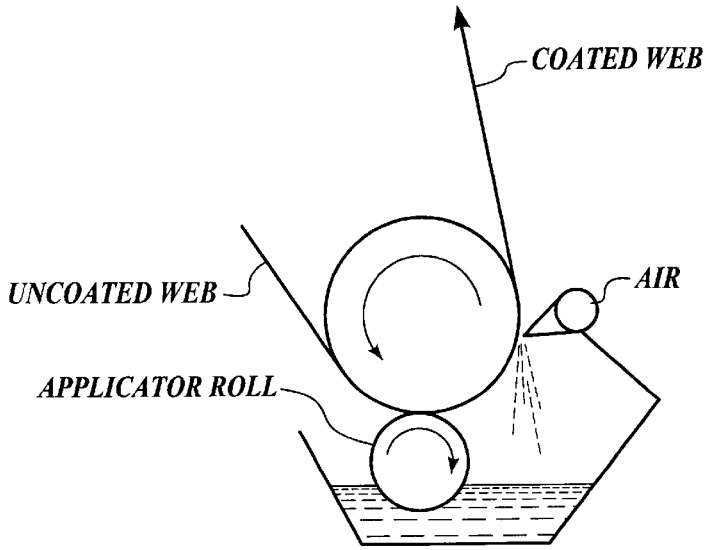
FIG. 7 is a schematic representation of an air knife.

In this example, a method for forming a polyethylene glycol coated paper is described. The polyethylene glycol coating is typically applied to paper that has been through a size and cut into smaller rolls for off-line specialty coatings. The coating can be applied using any method known in the industry including using, for example, a blade coater or an air knife coater. A representative air knife is illustrated schematically in FIG. 7. Because these devices can tolerate higher viscosity coating formulas, the applied formulations can include. pigment (e.g., silicas, clays) up to about 30 percent by weight in the coating, along with latex or polyvinyl alcohol binders.

The usefulness of polyethylene glycol having an average molar mass of 35,000 in forming coated paper was demonstrated as described below. Base paper prepared from a hardwood-softwood furnish and including precipitated calcium carbonate filler was obtained from. The base paper did not include size press starch or other size press additives. A first formulation containing 12 percent by weight polyvinyl alcohol and 5 percent by weight silica gel pigment was prepared. A second formulation was prepared by adding polyethylene glycol (average molar mass 35,000) sufficient to provide a formulation containing 2 percent by weight polyethylene glycol. A third formulation was prepared by adding polyethylene glycol (average molar mass 35,000) sufficient to provide a formulation containing 4 percent by weight polyethylene glycol. Each formulation was applied to the base paper using a laboratory blade coater. The resulting papers were dried with forced air to provide coated papers. The print quality of the coated papers was compared using an HP 694C printer by measuring the optical color densities. The results are summarized in Table 9.

TABLE 9

| Optical Density: Hewlett Packard 694C Printer. | | | | |
|---|---|---|---|---|
| Paper | Black | Cyan | Magenta | Yellow |
| PVA/Silica | 1.57 | 1.08 | 1.03 | 0.90 |
| PVA/Silica/2% PEG | 1.56 | 1.29 | 1.17 | 0.97 |
| PVA/Silica/4% PEG | 1.56 | 1.30 | 1.17 | 1.01 |

The results show that significant improvements in the color optical densities were obtained with the papers containing polyethylene glycol.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A paper, comprising polyethylene glycol having an average molar mass in the range from about 30,000 to about 50,000, starch as a binder, and colloidal silica, wherein the paper has improved ink jet print quality as measured by black, cyan, magenta, and yellow optical densities compared to a paper that does not include polyethylene glycol.

2. The paper of claim 1, wherein the polyethylene glycol has an average molar mass of about 35,000.

3. The paper of claim 1, wherein the polyethylene glycol is present in an amount from about 0.5 to about 15 percent by weight based on the total weight of the paper.

4. The paper of claim 1, wherein the polyethylene glycol is present in an amount from about 3 to about 5 percent by weight based on the total weight of the paper.

5. The paper of claim 1, wherein the polyethylene glycol is present in the paper throughout its thickness.

6. The paper of claim 1, wherein the polyethylene glycol comprises a surface coating.

7. The paper of claim 1, wherein the paper is formed using a size press.

8. The paper of claim 1, wherein the paper is. formed using a metered size press.

9. The paper of claim 1, wherein the paper is formed using a gate roll size press.

10.The paper of claim 6, wherein the paper is formed using an air knife.

11. The paper of claim 1, further comprises a surface size.

12. The paper of claim 11, wherein the surface size is selected from the group consisting of maleic anhydride, styrene, styrene-acrylic acids, stryrene-acrylic esters, and mixtures thereof.

13. The paper of claim 1 further comprising a pigment selected from the group consisting of calcium carbonate, clay, titanium dioxide, silica gel, fumed silica, precipitated silica, colloidal silica, and mixtures thereof.

14. The paper of claim 1 further comprising silica gel.

15. The paper of claim 1, wherein the paper is for receiving ink jet printing.

16. A paper, comprising polyethylene glycol having an average molar mass of about 35,000, starch as a binder, and colloidal silica, wherein the paper has improved ink jet print quality as measured by black, cyan, magenta, and yellow optical densities compared to a paper that does not include polyethylene glycol.

17. The paper of claim 16, wherein the polyethylene glycol is present in an amount from about 0.5 to about 15 percent by weight based on the total weight of the paper.

18. The paper of claim 16, wherein the polyethylene glycol is present in an amount from about 3 to about 15 percent by weight based on total weight of the paper.

19. The paper claim 16, wherein the polyethylene glycol is present in the paper throughtout its thickness.

20. The paper of claim 16, wherein the polyethylene glycol comprises a surface coating.

21. the paper of claim 16, further comprises a surface size.

22. The paper of claim 16, further comprising a pigment.

23. The paper of claim 16, wherein the paper is for receiving ink jet printing.

24. A method for forming a polyethylene glycol-containing paper, comprising:

forming a web from a paper furnish;

applying a polyethylene glycol-containing formulation to the web to provide a polyethylene glycol-containing web; and drying the web to provide a polyethylene glycol-containing paper, wherein the polyethylene-glycol-containing formulation comprises polyethylene glycol having an average molar mass of from about 30,000 to about 50,000, starch as a binder, and colloidal silica.

25. The method of claim 24, wherein the polyethylene glycol has an average molar mass of about 35,000.

26. The method of claim 24, wherein applying a polyethylene glycol-containing formulation to a web is practiced with a size press.

27. The method of claim 24, wherein applying a polyethylene glycol-containing formulation to a web is practiced with a metered size press.

28. The method of claim 24, wherein applying a polyethylene glycol-containing formulation to a web is practiced with a gate roll size press.

29. The method of claim 24, wherein the polyethylene glycol is present in the paper throughout its thickness.

30. The method of claim 24, wherein the polyethylene glycol comprises a surface coating.

31. A method for forming a polyethylene glycol-containing paper, comprising:

forming a web from a paper furnish;

applying a polyethylene glycol-containing formulation to the web using a size press to provide a polyethylene glycol-containing web; and drying the web to provide a polyethylene glycol-containing paper, wherein the polyethylene-glycol-containing formulation comprises polyethylene glycol having an average molar mass of from about 30,000 to about 50,000, starch as a binder, and colloidal silica.

32. The method of claim 31, wherein the size press is at least one of a metered size press and a gate roll size press.

* * * * *